US005938456A

United States Patent [19]

Kozel et al.

[11] Patent Number: 5,938,456

[45] Date of Patent: Aug. 17, 1999

[54] LOW PROFILE ELECTRICAL CONNECTOR

[75] Inventors: Charles A. Kozel, McHenry; John T. Scheitz, Barrington; Michael V. Stefaniu, Lake Zurich, all of Ill.

[73] Assignee: Methode Electronics, Inc., Chicago, Ill.

[21] Appl. No.: 08/944,132

[22] Filed: Oct. 6, 1997

Related U.S. Application Data

[63] Continuation of application No. 08/423,307, Apr. 19, 1995, abandoned.

[51] Int. Cl.[6] ..... H01R 13/41

[52] U.S. Cl. ..... 439/83; 439/733.1

[58] Field of Search ..... 437/81, 82, 78, 437/83, 682, 857; 439/58, 733.1

[56] References Cited

U.S. PATENT DOCUMENTS

| | | | |
|---|---|---|---|
| 4,682,829 | 7/1987 | Kunkle et al. | 439/83 OR |
| 4,767,342 | 8/1988 | Sato | 439/78 OR |
| 5,145,386 | 9/1992 | Berg et al. | 439/83 |
| 5,188,535 | 2/1993 | Bertho et al. | 439/83 OR |
| 5,197,891 | 3/1993 | Tanigawa et al. | 439/83 OR |

FOREIGN PATENT DOCUMENTS 0 633 634 A2 6/1994 European Pat. Off. .

OTHER PUBLICATIONS

HRS, DF9 Series SMT 1mm Center Line Board to Board Connector specification.

AMP, AMPMODU Metristak 1 mm Board–to–Board Connector System specification, 1992.

*Primary Examiner*—Gary Paumen
*Assistant Examiner*—Daniel Wittels
*Attorney, Agent, or Firm*—David L. Newman

[57] ABSTRACT

An electrical connector is provided for forming a connection with a conductive pin. The electrical connector has a dielectric housing with both a passage extending through the housing and a chamber in communication with the passage. In addition, the electrical connector has a metal contact with a mating end disposed in the housing's chamber and a solder tail which projects from the housing. The mating end of the contact consists of a clamping stirrup which has a bottom area with a hole disposed therein for receiving the conductive pin. Furthermore, the contact is three dimensionally secured to the connector housing via a press-fit.

18 Claims, 11 Drawing Sheets

LOW PROFILE ELECTRICAL CONNECTOR

This is a continuation of application Ser. No. 08/423,307, filed Apr. 19, 1995 now abandoned.

BACKGROUND OF THE INVENTION

This invention pertains to a low profile electrical connector, and in particular to a connector having contacts which are novel in their design and in the technique used to mount them to the connector housing.

Many different types of electrical connectors are available which have a dielectric housing with several passages extending through the housing. An electrical connection is achieved by inserting a conductive pin within any of the connector's passages. Correspondingly, an electrical contact is associated with each of the connector passages. The electrical contact is mounted to the connector housing and has a mating portion which forms the electrical connection with the conductive pin. Normally, each of the contacts within the electrical connector are formed by a manufacturing process consisting of stamping and shaping a metal sheet.

The above described connector and contact configuration is typically used in applications involving small electrical devices which require a connector housing having a low profile. Many of these low profile electrical connectors have a small contact pitch (spacing) and are capable of receiving a conductive pin in either of two opposite directions. However, a need exists for even smaller electrical connectors for use in miniaturized devices such as cellular phones, pagers, notebook computers, and computer disk drives.

In addition, one problem with the above described connectors is their inability to provide a reliable electrical connection between the mating portion of the contact and the conductive pin. Furthermore, the above described electrical connectors do not effectively secure the contact to the connector housing. In response to these problems, this invention provides a connector with a low profile and contacts which are unique in their design and in the means used to mount them to the connector housing.

In view of the above, it is an object of the present invention to provide a connector which accepts a conductive pin from either the top or bottom of the connector.

In addition, it is an object of the present invention to provide a secure three dimensional retention of the contact to the connector housing in order to firmly hold and accurately position the solder tail and mating portion of the contact.

It is also an object of the present invention to provide a free standing contact.

Also, it is an object of the present invention to provide a contact with a mating portion having two points of contact.

Furthermore, other objects, features, and advantages of the present invention will be apparent from the following detailed description taken in connection with the accompanying drawings.

SUMMARY OF THE INVENTION

In one form of the invention, an electrical connector is provided for forming a connection with a conductive pin. The connector has a dielectric housing with a passage extending through the housing. Also, the housing has a chamber in communication with the passage. In addition, secured to the connector housing is a metal contact with both a mating end disposed in the housing's chamber and a solder tail which projects from the housing. The mating end of the contact consists of a stirrup with a bottom area having a hole disposed therein for receiving the conductive pin.

In an embodiment, the invention further provides for ale electrical connector housing to include a top surface and a bottom surface with the passage extending therebetween. In addition, the housing may have a side wall with an opening in communication with the chamber. Furthermore, two mounting posts may be located on each side of the opening.

In another embodiment, the invention provides for the contact to be three dimensionally secured to the connector housing via, e.g., a press-fit. The press-fit may be formed between the two mounting posts and the contact. Furthermore, each mounting post may have a channel for facilitating the press-fitting of the contact to the connector housing.

In another embodiment, the contact's stirrup may include two arms for mating with the conductive pin. Furthermore, the electrical contact may be stamped and formed of sheet metal.

In yet another form of the invention, an electrical connector is provided for forming an electrical connection with a conductive pin. The electrical connector has a dielectric housing with a passage extending through the housing for receiving the conductive pin. The passage is in communication with a chamber which is also located in the housing. Furthermore, the chamber is in communication with an opening in the housing. Finally, the housing has two mounting posts located adjacent to the opening.

Three dimensionally secured to the connector housing is a metal contact with a mating end disposed in the housing's chamber and a solder tail projecting from the housing. The contact is three dimensionally secured to the housing via a press-fit with the mounting posts extending from the housing.

In another embodiment, the electrical connector further includes a top surface and a bottom surface with the passage extending therebetween. Furthermore, the electrical contact may include a side wall with the chamber opening located therein.

In another embodiment, the mating end of the contact consists of a clamping stirrup. The stirrup may have a bottom with a hole disposed therein for receiving the conductive pin. Furthermore, the stirrup may include two arms for mating with the conductive pin.

In another embodiment, the metal contact may be stamped and formed of sheet metal. Furthermore, the contact may include tabs for facilitating the contact's press-fit onto the connector housing.

Various means for practicing the invention and other advantages and novel features thereof will be apparent from the following detailed description of an illustrative preferred embodiment of the invention.

BRIEF DESCRIPTION OF THE DRAWINGS

There is shown in the drawings a presently preferred embodiment of the present invention, wherein like numerals in the various figures pertain to like elements and wherein.

DETAILED DESCRIPTION OF THE PRESENTLY PREFERRED EMBODIMENTS

Figure 1:
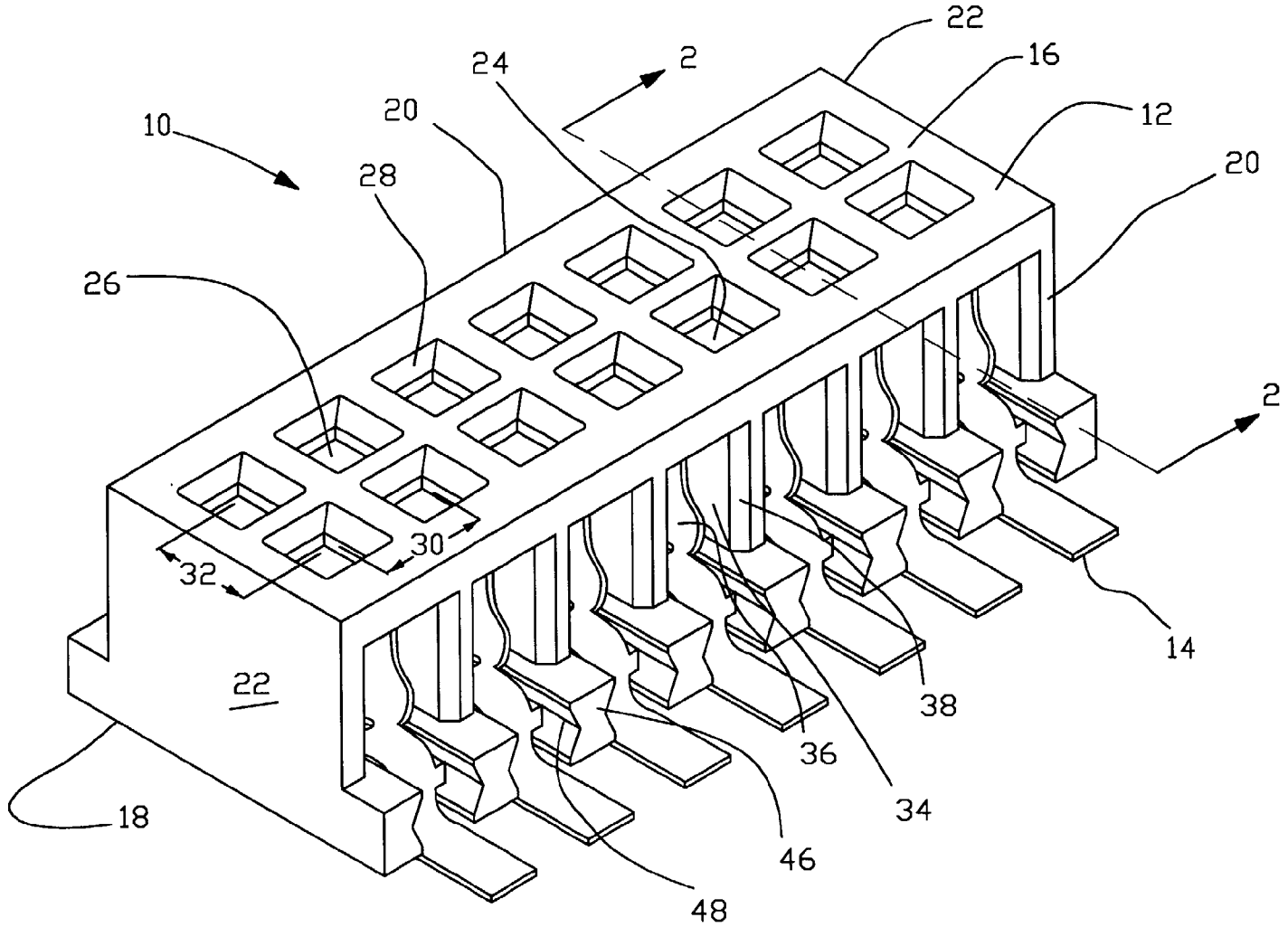
FIG. 1 is an enlarged perspective view of an electrical connector assembly incorporating the concepts of the invention.

Referring to the drawings, and particularly to FIG. 1, an enlarged perspective view of an electrical connector assembly 10 is depicted. The electrical connector assembly 10 includes a unitary dielectric housing 12 and a plurality of contacts 14. The housing 12 is generally rectangular in shape with a top surface 16, an opposite bottom surface 18, a pair of side walls 20 connected to both the top and bottom, and two end walls 22 connected to the top, bottom, and sides. In the preferred embodiment, the housing 12 is molded of a high temperature thermoplastic polymer material such as LCP, 30% G/R, VECTRA E-130, UL 94V-0.

The housing 12 contains several passages 24 which extend from the top surface 16, through the housing 12, and to the bottom surface 18. Furthermore, an opening 26 with a tapered lead-in 28 is located on each end of each passage 24.

In FIG. 1, the passages 24 are aligned so that they form two rows of seven passages. In the preferred embodiment, the pitch (spacing) between the center of the passages 24 in each row is 1.0 mm as indicated by doubled-headed arrow 30. Likewise, the pitch (spacing) between the center of the passages 24 in the respective rows is 1.0 mm as indicated by double-headed arrow 32. However, it should be considered obvious that other configurations of the connector assembly 10 may be constructed with a different pitch and number of passages 24.

The housing 12 also contains several contact chambers 34. Each contact chamber 34 is in communication with one passage 24 and has an opening 36 located in the side wall 20 of the housing 12. As describe further in this specification, each contact chamber 34 receives one contact 14. Furthermore, each contact chamber opening 36 is generally rectangular in shape and has a tapered lead-in 38.

Figure 2:
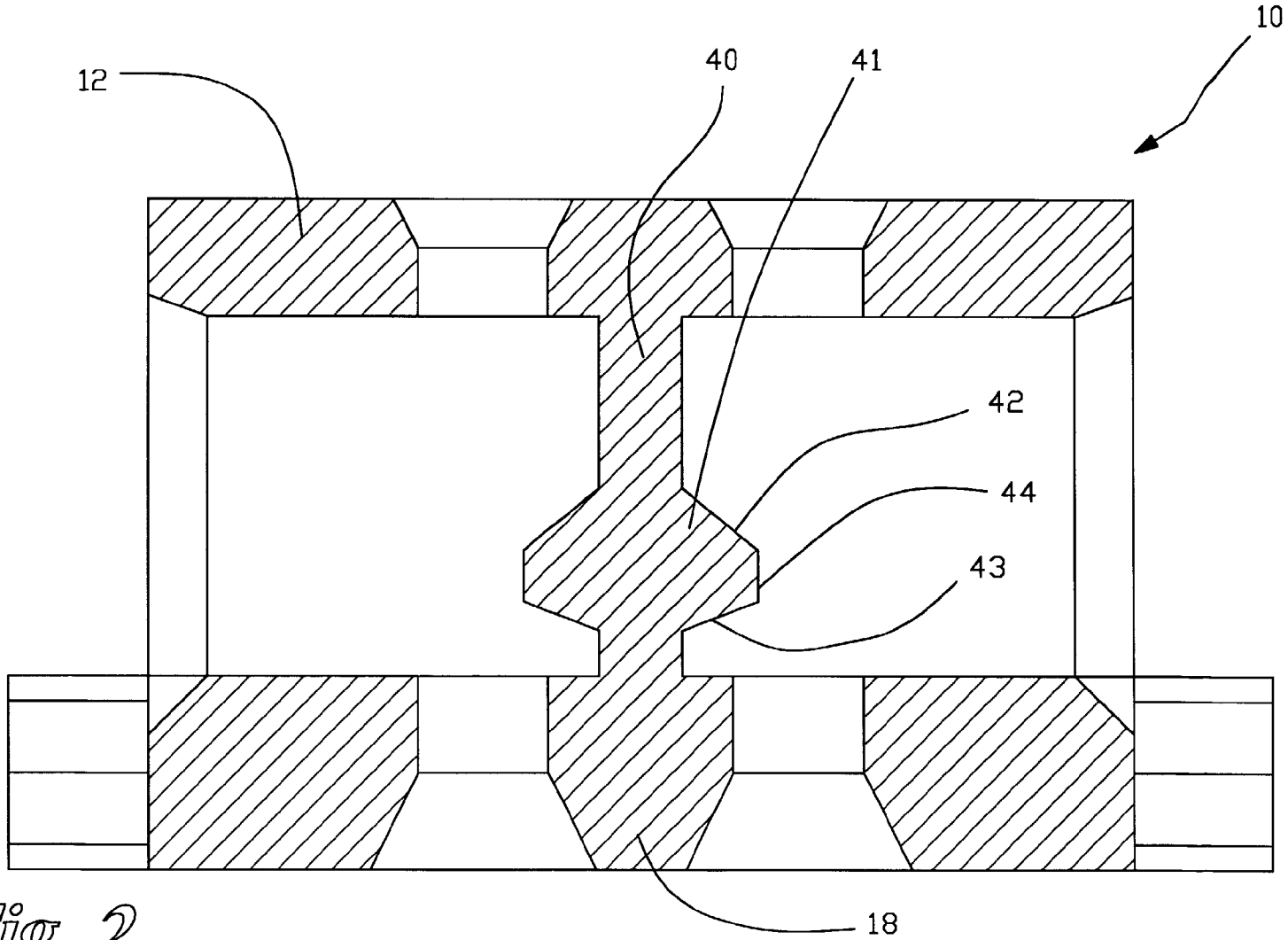
FIG. 2 is a further enlarged cross-sectional view of the electrical connector assembly depicted in FIG. 1, taken at line 2—2, with the contacts removed.

Referring to FIG. 2, a cross-section of the connector assembly 10 depicted in FIG. 1 is shown, taken along line 2—2, with the contacts 14 removed. As shown in FIG. 2, opposite the opening 36 to each contact chamber 34 is a back wall 40. The back wall 40 has a retaining tab 41 which extends from the center of the back wall near the bottom 18 of the housing 12. The retaining tab 41 is generally rectangular in shape with a top 42, a bottom 43, and a distal end 44. The top 42 and bottom 43 of the retaining tab 41 angle towards each other as they approach its distal end 44. In the preferred embodiment, the top 42 has a typical slope of twenty-five degrees while the bottom 43 has a typical slope of fifteen-degrees. Furthermore, the top 42 of the retaining tab 41 is slightly rounded.

Referring back to FIG. 1, mounting posts 46 are provided between each opening 36 in the side walls 20. The mounting posts 46 extend perpendicular from each side wall 20 and are positioned adjacent to the bottom surface 18 of the housing 12. Correspondingly, each opening 36 has two mounting posts 46 associated with it. Each mounting post 46 has a V-shaped channel 48 extending along its entire length and the mouth of the channel faces directly towards the other mounting post associated with the same opening 36.

Figure 3:
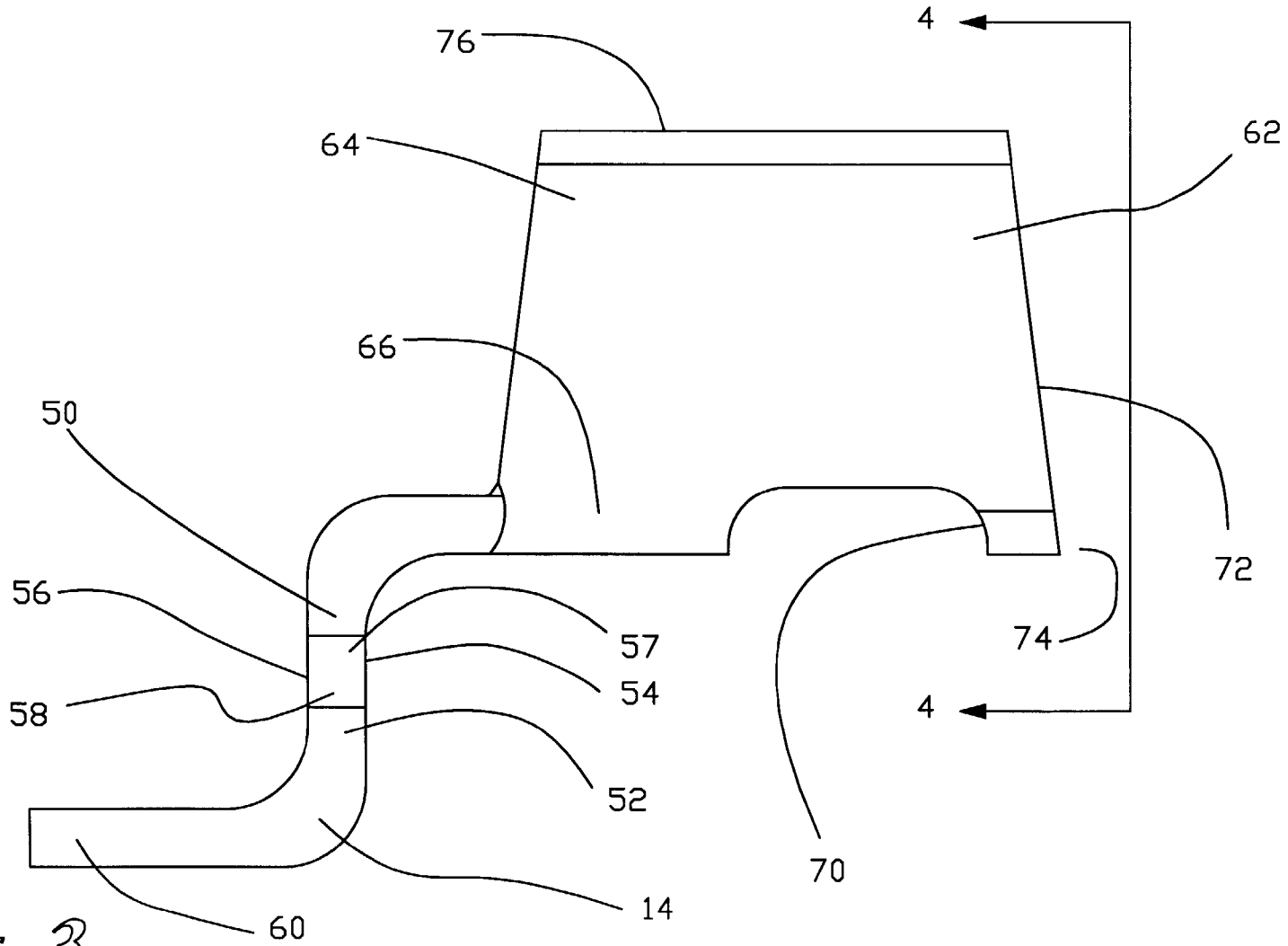
FIG. 3 is a further enlarged side view of one of the contacts which is mounted to the connector assembly depicted in FIG. 1.
Figure 4:
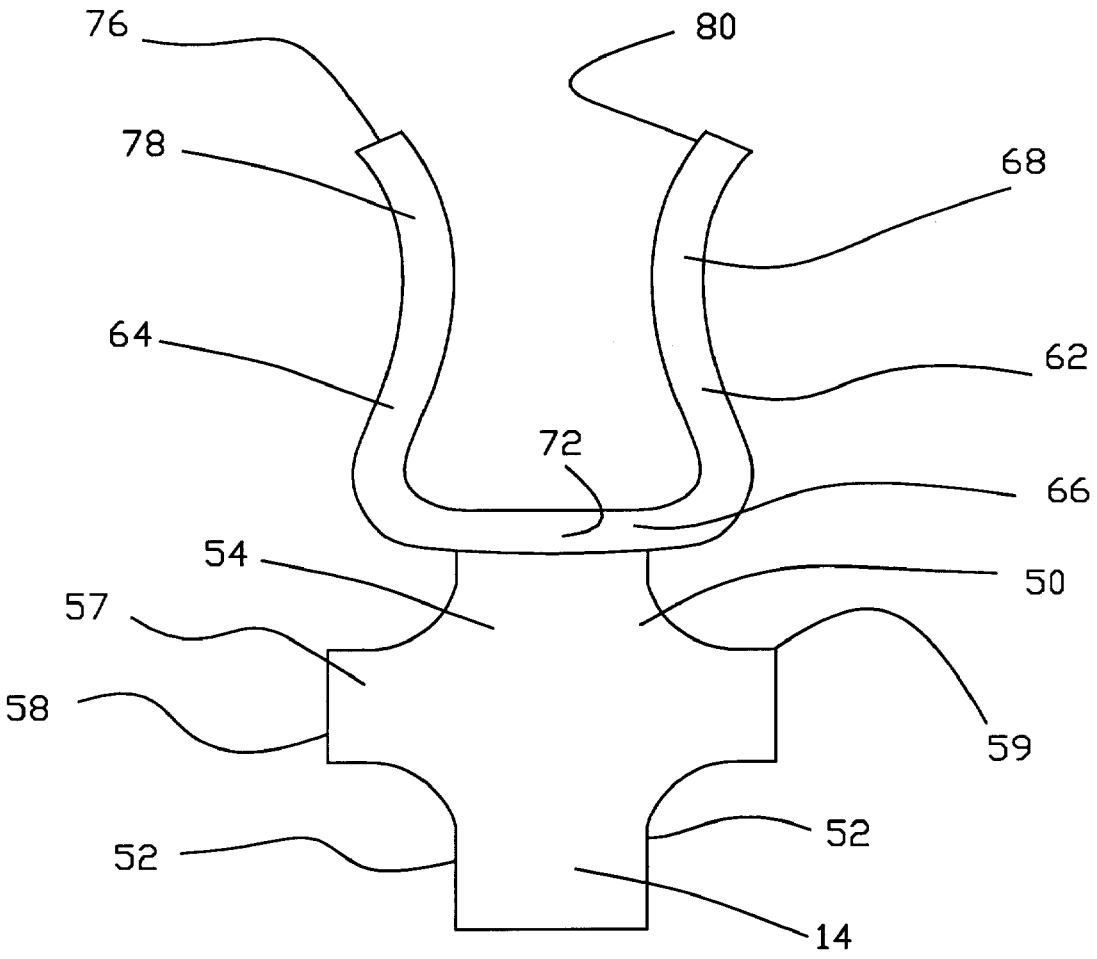
FIG. 4 is an end view of the contact depicted in FIG. 3, taken at line 4—4.

Referring to FIGS. 3 and 4, a side and end view, respectively, is depicted of one of the contacts 14 which is mounted to the connector assembly 10 of FIG. 1. Each contact 14 is made from a flat piece of sheet metal which is stamped and formed so that it includes an elongated contact body 50 with two sides 52 and opposite first and second flat surfaces, 54 and 56 respectively. In the preferred embodiment, the contact 14 is made of beryllium copper.

Protruding from each side 52 of the contact body 50 is an ear 57. Each ear 57 has a flat distal end 58 with two sharp comers 59.

Furthermore, one end of the contact body 50 has a solder tail 60 which extends perpendicularly from the second flat surface 56 of the contact body 50 and is used for forming an electrical connection with the solder pads of a printed circuit board or the like. In addition, a mating portion 62 extends from the other end of the contact body 50 and away from the first flat surface 54 of the contact body 50 in a perpendicular manner. The mating portion 62 is shaped to form a clamping stirrup 64. The stirrup 64 consists of a bottom area 66 which extends from the contact body 50 and two arms 68 which generally extend parallel to each other. In the preferred embodiment, the stirrup 64 is gold plated.

Located in the bottom 66 of the stirrup 64 and extending into a portion of the arms 68 is an access hole 70. The access hole 70 is generally rectangular in shape and is adjacent the distal end 72 of the contact 14. Between the access hole 70 and the distal end 72 of the contact 14 is a lip 74 consisting of a portion of the stirrup bottom 66.

In order to form a continuous electrical connection, located adjacent the distal end 76 of each arm 68 is a bowed section 78. The bowed section 78 is formed so that it causes the contact arms 68 to extend towards each other. Furthermore, the distal ends 76 give the stirrup 64 a wide mouth 80 between the arms 68.

Figure 5:
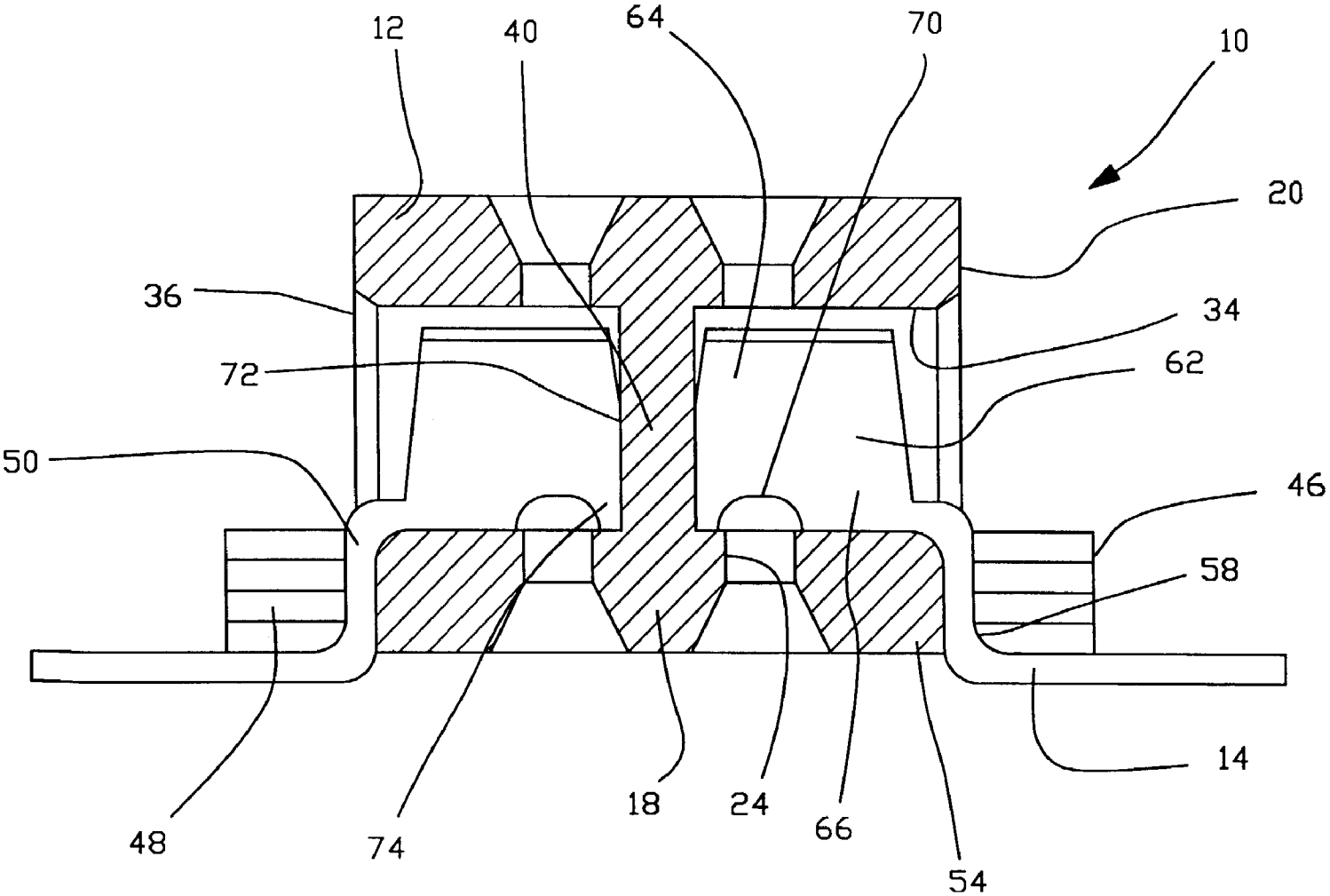
FIG. 5 is a partial cross-sectional view of the electrical connector assembly depicted in FIG. 1, taken at line 2—2.

Referring to FIG. 5, a partial cross-sectional view of the electrical connector assembly 10 depicted in FIG. 1 is shown, taken at line 2-2. As stated above, within each chamber 34 is the mating portion 62 of a corresponding contact 14 which in the preferred embodiment consists of a stirrup 64. The bottom 66 of the stirrup 64 abuts the bottom 18 of the connector housing 12. Likewise, the stirrup access hole 70 is positioned over the passage 24 so that a pin can be inserted from one end of the passage to the other. Finally, the lip 74 of the stirrup 64 is positioned against the back wall 40 and between the connector housing bottom 18 and the retaining tab bottom 43.

Figure 6:
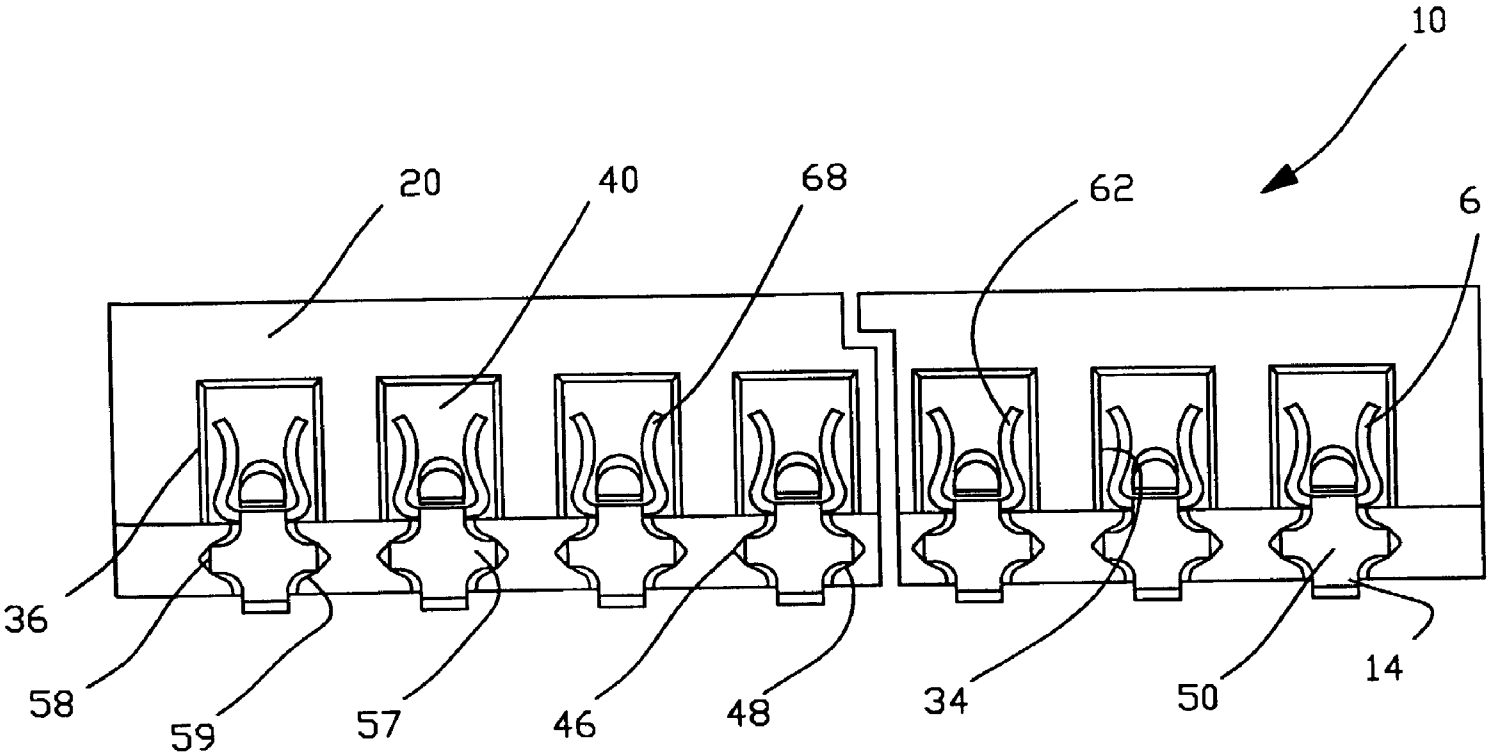
FIG. 6 is a side view of the electrical connector assembly of FIG. 1.

Turning to FIG. 6, a side view of the electrical connector assembly 10 of FIG. 1 is depicted. Each stirrup 64 occupies a chamber 34 having a width greater than the width of the stirrup arms 68 so that its arms 68 are allowed to move away from each other (i.e., free standing). Furthermore, the body 50 of each contact 14 is positioned between two mounting posts 46 so that each ear 57 of each contact occupies the corresponding mounting post channel 48.

Referring to both FIGS. 5 and 6, the contact 14 is placed within the chamber 34 by inserting the distal end 72 of the contact within the opening 36 in the side 20 of the housing 12. The contact mating portion 62 is then slid into the chamber 34 until the distal end 72 of the contact abuts the back wall 40. As the contact mating portion 62 is being slid into position, the ears 57 of the contact 14 will abut against the distal ends of the two mounting posts 46 associated with the chamber 34. The ears 57 will abut against the posts 46 because the distance between the ends 58 of the ears is greater than the space provided by the two mounting posts and their channels 48. As the contact mating portion 62 is forced further into the chamber 34 by pressing against the contact body 50, the ears 57 will become bowed so that they occupy the limited space provided by the two mounting posts 46 and their respective channels 48. Due to the resiliency of the ears 57, the corners 59 of each ear 57 will fit within the channels 48 and press against the mounting posts 46. The result of the pressing of the corners 59 against the mounting posts 46 will result in a retention of the contact 14 to the housing 12 via a press-fit. Finally, the mating portion 62 is positioned into the chamber 34 as shown in FIG. 5 with the first flat surface 54 of the contact 14 abutting against the side wall 20 of the housing 12.

With the contact 14 attached to the housing 12 as shown in FIG. 5, the press-fit provides a secure three dimensional retention of the contact to the housing. The three dimensional retention prevents the contact body 50 from moving in any direction.

In addition, the retention of the contact 14 to the housing 12 is provided in close proximity to the contact solder tail 60. The proximate location of the retention area to the contact solder tail 60 ensures that the contact solder tail will extend perpendicularly from the connector housing 12 and also provides co-planarity between each one of the contact solder tails.

The contact assembly of FIG. 1 is capable of mating with conductive pins of many various configurations. For example, referring to FIG. 7, an enlarged end view of a conventional header 82 is depicted with a plurality of conductive pins 84 for mating with the connector assembly 10 of FIG. 1. The header 82 has an insulator plate 86 with the distal end of the conductive pins 84 extending perpendicularly from the plate. The header pins 84 are arranged in a pattern which corresponds to the configuration of the passages 24 within the connector assembly housing 12. Furthermore, each of the header pins 82 is made of conductive metal material and can have a square, rectangular, or round cross-section.

Figure 7:
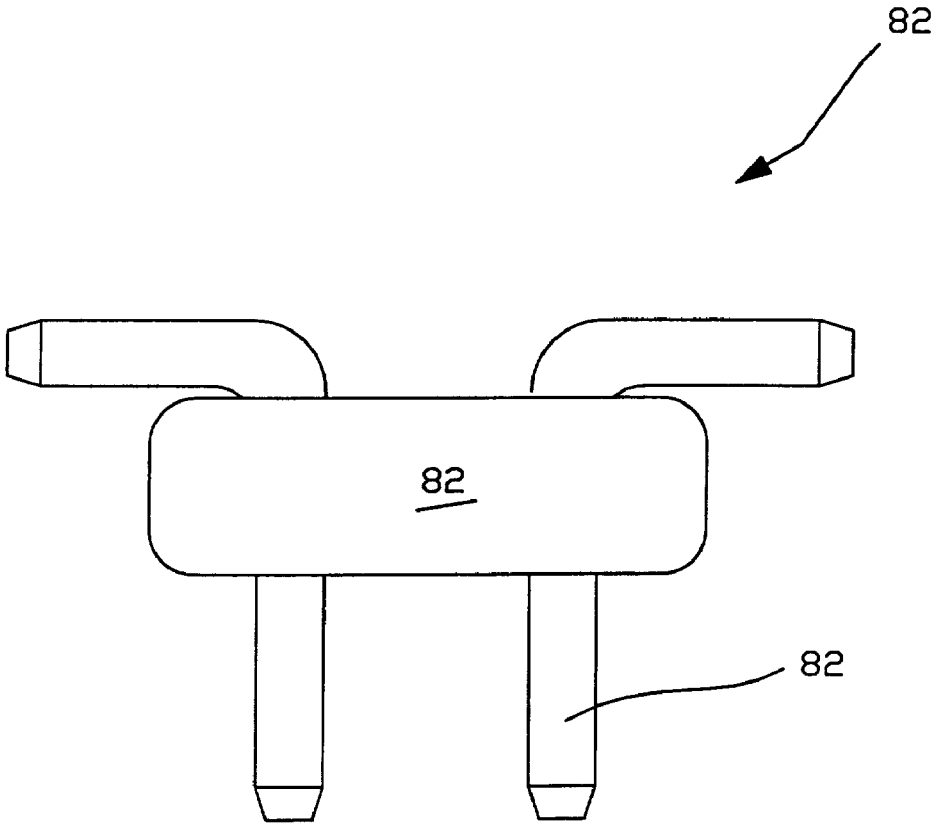
FIG. 7 is an enlarged end view of a conventional header having a plurality of conductive pins for mating with the connector assembly of FIG. 1.
Figure 8:
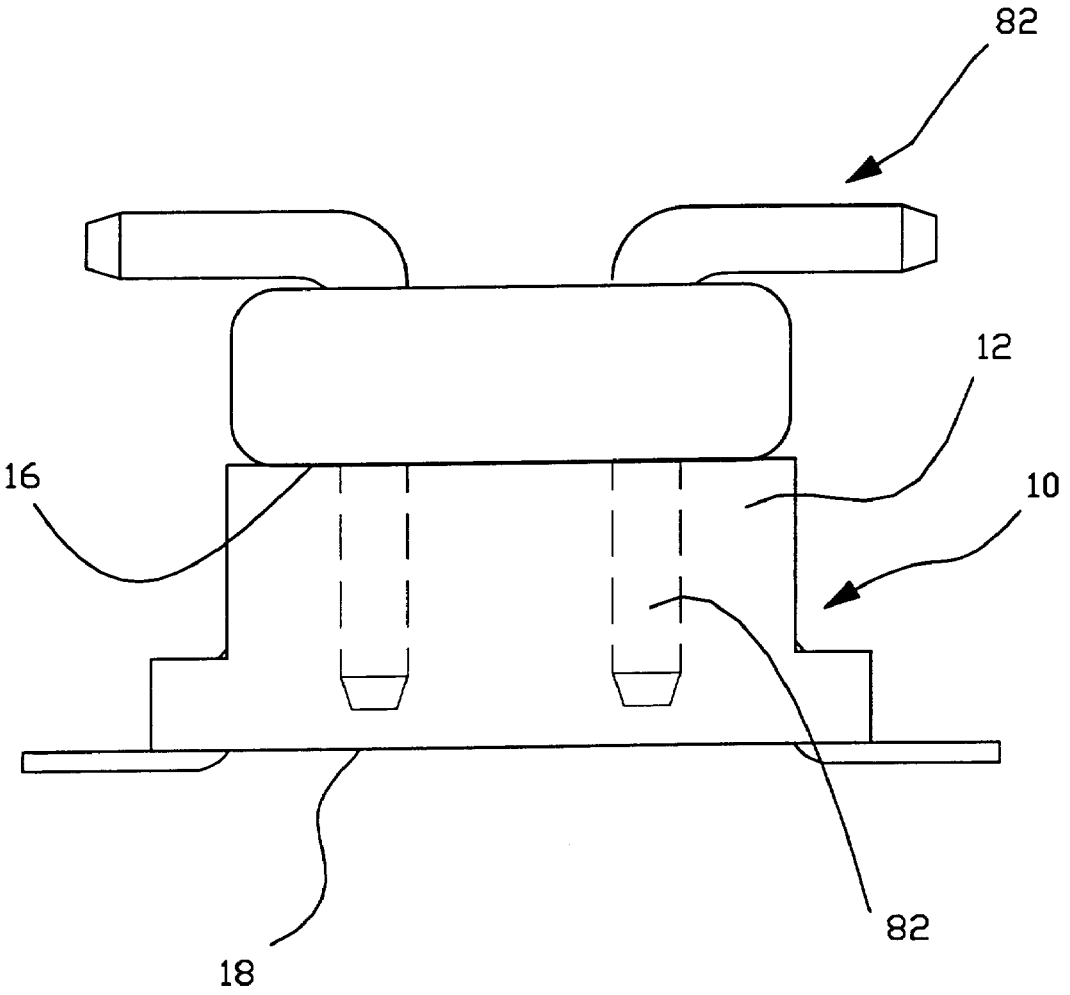
FIG. 8 is an end view of the header of FIG. 7 in mated relationship with the connector assembly of FIG. 1.
Figure 9:
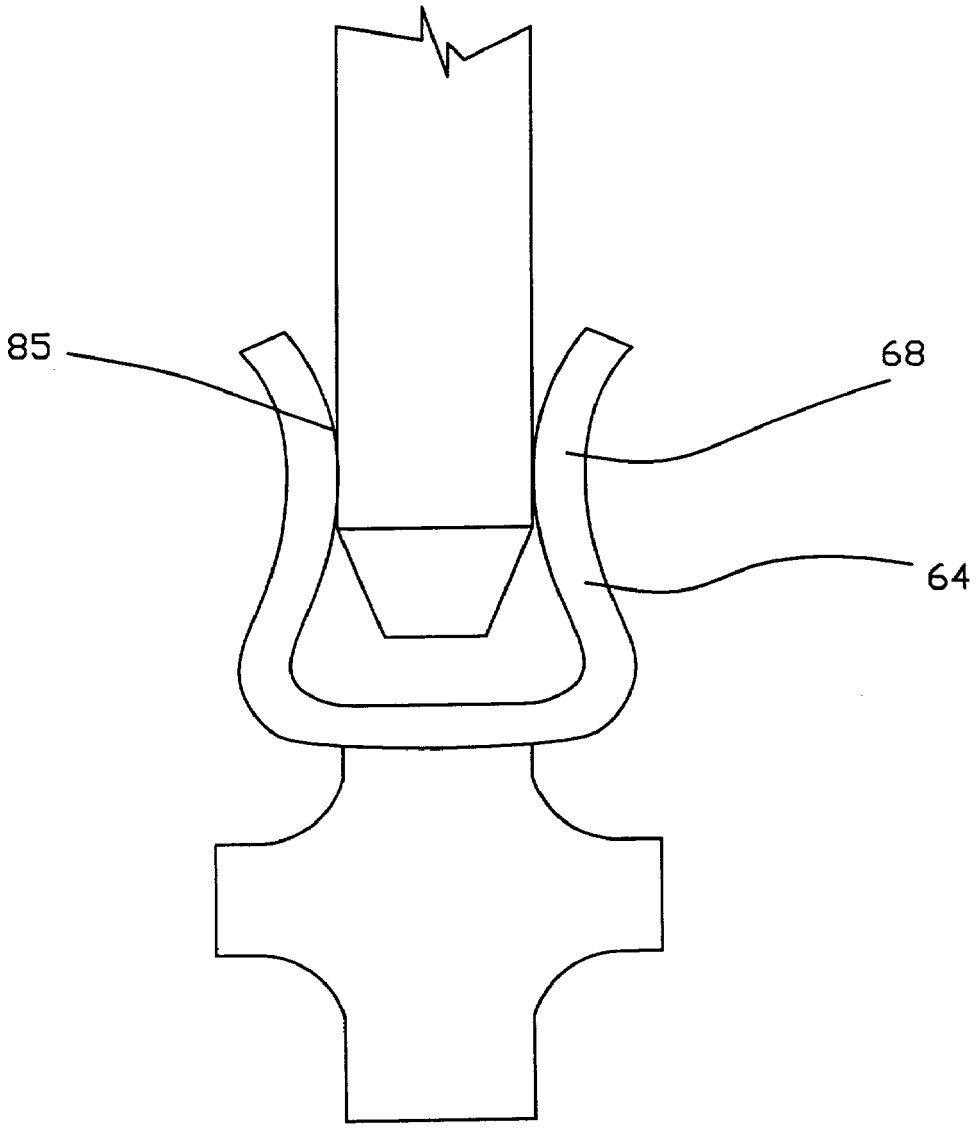
FIG. 9 is an end view of the contact depicted in FIG. 3, taken at line 4—4, in mated relationship with a conductive pin.
Figure 10:
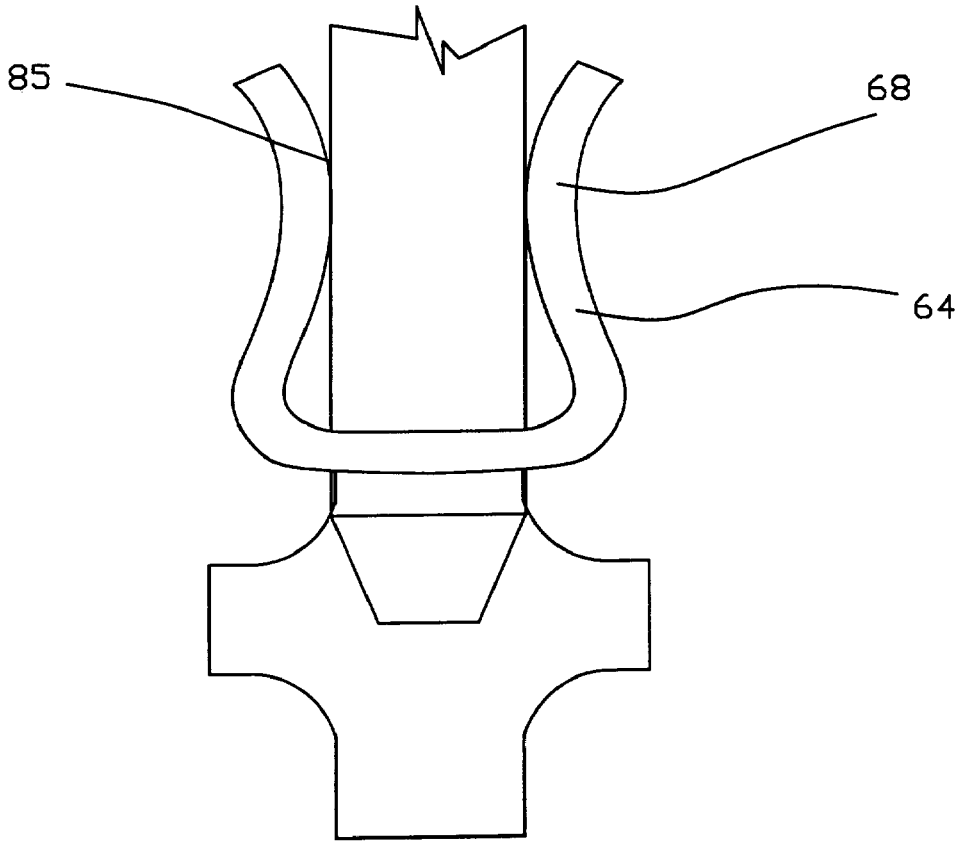
FIG. 10 is an end view of the contact depicted in FIG. 3, taken at line 4—4, in mated relationship with a conductive pin which extends through the access hole.

Referring to FIG. 8, an end view of the header 82 of FIG. 7 is shown in mated relationship to the connector assembly 10 of FIG. 1. Corresponding, the header pins 84 extend within the connector passages 24. The header 82 is mated with the connector assembly 10 by aligning the header pins 82 with the connector housing passages 24 and then inserting the header pins into the passages. As the header pins 84 pass through the connector housing 12, the pins will abut against the mouth 80 of the stirrup 64 depicted in FIG. 4. As each pin 84 is pressed further within the passage 24, the arms 68 of the stirrup 64 will separate and allow that pin to continue through the housing 12. However, referring to FIG. 9, the arms 68 of the stirrup 64 will resiliently press against the contact pin 84 and thus form a solid electrical connection between the pin and the contact 14 via two points of contact 85. Furthermore, as shown in FIG. 10, the pin 84 may extend through the stirrup access hole 70.

Figure 11:
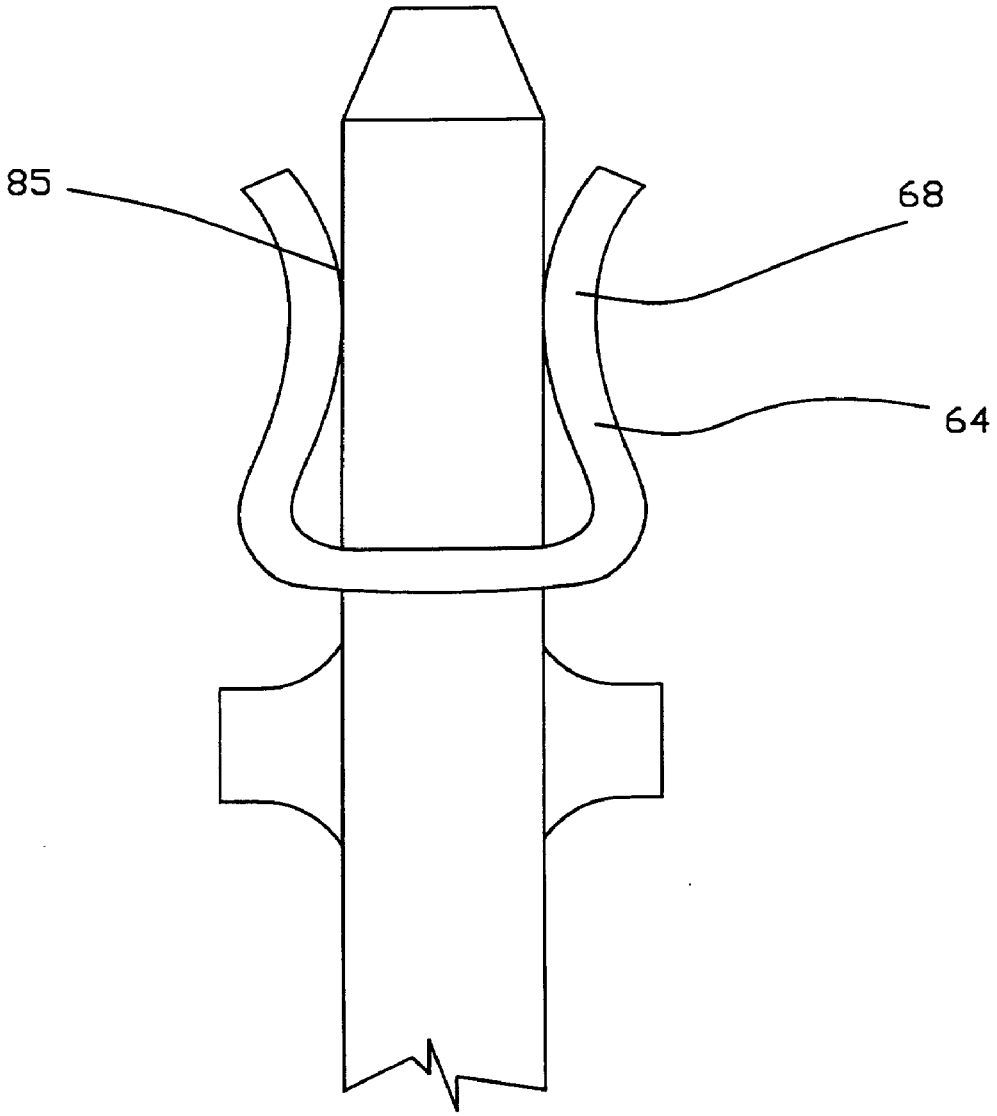
FIG. 11 is an end view of the contact depicted in FIG. 3, taken at line 4–4, in mated relationship with a conductive pin which is inserted through the bottom of the connector assembly.

Although the header 82 in FIG. 8 is shown being mounted to the top 16 of the contact assembly 10, the header may also be mounted to the bottom 18 of the contact assembly 10. The header 82 is mated to the connector bottom 18 by aligning and inserting the header pins 84 within the openings 26 in the bottom of the connector. As each header pin 84 is pressed within a corresponding passage 24, the pin will pass through the access hole 70 in the bottom 66 of the stirrup 64 as shown in FIG. 3. As the pin 84 extends further within the passage, it will press against the arms 68,68 of the stirrup 64 which will separate and allow that pin to continue through the housing 12 as shown in FIG. 11. However, the arms 68,68 of the stirrup 64 will press against the pin 84 and thus form a solid electrical connection between the pin and the contact 14 via two points of contact.

Likewise, instead of the pins 84 being mounted on a header 82, the pins may simply extend from a printed circuit board or other such structure.

It should also be understood that in describing the top and bottom of the connector assembly 10, and its respective components, the terms "top" and "bottom" are used by way of example only due to the orientation of the drawings. It should also be understood that various changes and modifications to the presently preferred embodiments described herein will be apparent to those skilled in the art. Therefore, changes and modifications may be made without departing from the spirit and scope of the present invention and without diminishing its attendant advantages. Thus, it is intended that such changes and modifications be covered by the appended claims.

We claim:

1. An electrical connector for forming an electrical connection with a conductive pin, said electrical connector comprising:

(a) a dielectric housing having a passage extending through said housing for receiving said conductive pin, the passage extending generally through a top surface and a bottom surface of the housing, said housing also having a chamber therein in communication with said passage and channels transverse to said passage; and (b) a metal contact secured to said housing, the contact having generally a Y-shaped contact body having a mating end disposed in said chamber and the mating end forming shoulders and an elongated rectangular shape neck portion projecting from said shoulders, said mating end consisting of a clamping stirrup with a bottom area having a hole disposed therein for receiving said conductive pin and an intermediate portion separated from said mating end by said neck portion, the intermediate portion being adjacent to a solder tail, and a pair of ears projecting from said intermediate portion and mounted within said channels wherein the intermediate portion and the ears project in a plane parallel to a longitudinal axis of the passage.

2. The electrical connector of claim 1, wherein said housing further includes a top surface and a bottom surface with said passage extending therebetween.

3. The electrical connector of claim 1, wherein said housing further includes a side wall with an opening in communication with said chamber.

4. The electrical connector of claim 1, wherein said contact and housing includes a means for three dimensionally securing said contact to said housing.

5. The electrical connector of claim 4, wherein said securing means is provided by a press-fit.

6. The electrical connector of claim 5, wherein said press-fit is formed between two mounting posts and said contact.

7. The electrical connector of claim 6, wherein each of said mounting posts has a channel with said contact pressing against said channel.

8. The electrical connector of claim 1, wherein said stirrup further includes a plurality of arms for mating with said conductive pin.

9. The electrical connector of claim 1, wherein said contact is stamped and formed of sheet metal.

10. An electrical connector for forming an electrical connection with a conductive pin, said electrical connector comprising:

(a) a dielectric housing including (i) a passage extending through said housing for receiving said conductive pin, the passage extending generally through a top surface and a bottom surface of the housing;

(ii) a chamber in communication with said passage;

(iii) an opening in said housing and in communication with said chamber; and (iv) two mounting posts adjacent to said opening; and (b) a metal contact including a contact body having a mating end disposed in said chamber and a neck portion projecting from said housing, said neck portion formed of an elongated member rectangular in cross-section and having a first portion protruding from the mating end of the contact body, and an intermediate portion between the first portion and a solder tail that forms a terminal point of the contact, wherein the intermediate portion includes a pair of ears protruding from said intermediate portion, said contact being three dimensionally secured to said housing via said ears press-fit with said mounting posts, wherein the intermediate portion and the ears project in a lane parallel to a longitudinal axis of the passage.

11. The electrical connector of claim 10, wherein said housing further includes a top surface and a bottom surface with said passage extending therebetween.

12. The electrical connector of claim 10, wherein said housing further includes a side wall with said opening located therein.

13. The electrical connector of claim 10, wherein said mating end consists of a clamping stirrup.

14. The electrical connector of claim 13, wherein said clamping stirrup further includes a bottom with a hole disposed therein for receiving said conductive pin.

15. The electrical connector of claim 14, wherein said stirrup further includes a plurality of arms for mating with said conductive pin.

16. The electrical connector of claim 10, wherein said metal contact further include tabs for facilitating said press-fit.

17. The electrical connector of claim 10, wherein said contact is stamped and formed of sheet metal.

18. An electrical connector for forming an electrical connection with a conductive pin, said electrical connector comprising:

(a) a dielectric housing having:

(i) a top surface and a bottom surface with a passage extending therethrough for receiving said conductive pin;

(ii) a chamber in communication with said passage;

(iii) a side wall extending generally between and connecting the top surface and the bottom surface and having an opening in communication with said chamber; and (iv) two mounting posts with each of said mounting posts having a channel; and (b) a metal contact stamped and formed of a sheet metal elongated contact body including a neck portion and an intermediate portion between the neck portion and a solder tail of the elongated contact body, the neck portion protruding from shoulders of mating end of the contact wherein the mating end is generally U-shaped, the elongated contact body having a pair of ears projecting from said intermediate portion, the intermediate portion and the ears projecting in a plane parallel to a plane of the side wall, the contact three dimensionally secured to said housing via said pair of ears press-fit within said mounting post channels, said metal contact having said mating end disposed in said chamber and said solder tail projecting from said housing, said mating end consisting of a clamping stirrup with a bottom area having a hole disposed therein for receiving said conductive pin and two arms for mating with said conductive pin.

* * * * *